United States Patent [19]

Bouchakian

[11] Patent Number: 4,771,541

[45] Date of Patent: Sep. 20, 1988

[54] COMBINATION FORK AND KNIFE

[76] Inventor: Myron Bouchakian, 555 Hahaione St., Apt 15-C, Honolulu, Hi. 96825

[21] Appl. No.: 72,669

[22] Filed: Jul. 13, 1987

[51] Int. Cl.[4] ..... A47J 43/28

[52] U.S. Cl. ..... 30/148; 30/322; D7/148

[58] Field of Search ..... 30/148, 322; D7/137, D7/148

[56] References Cited

U.S. PATENT DOCUMENTS

| | | | |
|---|---|---|---|
| Re. 9,687 | 5/1881 | Cox . | |
| D. 18,455 | 7/1888 | Richmond | 30/148 X |
| D. 18,776 | 12/1888 | Cox | 30/148 X |
| D. 22,992 | 12/1893 | Buehl . | |
| D. 27,820 | 11/1897 | Birtcherd | 30/148 X |
| D. 38,292 | 10/1906 | McClure . | |
| D. 42,622 | 6/1912 | Gafinowitz . | |
| D. 48,101 | 11/1915 | Cox . | |
| D. 63,047 | 9/1923 | Adler . | |
| D. 94,390 | 1/1935 | Phillips . | |
| 88,370 | 3/1869 | Cox | 30/148 |
| 331,177 | 11/1885 | Albin . | |
| 399,109 | 3/1889 | Wynkoop | 30/148 |
| 498,627 | 5/1893 | Cox | 30/148 |
| 536,862 | 4/1895 | Eros . | |
| 1,272,661 | 7/1918 | Hashiguchi . | |
| 1,294,031 | 2/1919 | Bigelow | 30/148 |
| 2,685,734 | 8/1954 | Klein . | |
| 3,771,224 | 11/1973 | Bono, Jr. . | |

FOREIGN PATENT DOCUMENTS

| | | |
|---|---|---|
| 1453665 | 8/1966 | France . |

*Primary Examiner*—E. R. Kazenske
*Assistant Examiner*—Michael D. Folkerts
*Attorney, Agent, or Firm*—H. Jay Spiegel

[57] ABSTRACT

Disclosed herein is an improved combination fork and knife which includes a fork portion having a plurality of tines, a knife portion including an elongated cutting edge and a tab structure located on a side thereof opposed to the cutting edge, which tab portion is designed to be engaged by the index finger of the user to aid in applying pressure when using the cutting edge. In a further aspect, an indicator is incorporated into the utensil which is designed to enable the user to discern the exact location on the utensil where the cutting edge begins so as to avoid cutting of the user's mouth.

6 Claims, 2 Drawing Sheets

COMBINATION FORK AND KNIFE

BACKGROUND OF THE INVENTION

In the prior art, numerous examples exist of combination utensils which combine various features of forks, knives and spoons into a single utensil. The following prior art is known to applicant:

U.S. Pat. No. 22,992 to Buehl
U.S. Pat. No. 27,820 to Birtcherd
U.S. Pat. No. 38,292 to McClure
U.S. Pat. No. 42,622 to Gafinowitz
U.S. Pat. No. 48,103 to Cox
U.S. Pat. No. 63,047 to Adler
U.S. Pat. No. 94,390 to Phillips
U.S. Pat. No. 331,177 to Albin
U.S Pat No. 498,627 to Cox
U.S. Pat. No. 536,862 to Eros
U.S. Pat. No. 1,272,661 to Hashiguchi
U.S. Pat. No. 1,294,031 to Bigelow
U.S. Pat. No. 2,685,734 to Klein
U.S. Pat. No. 3,771,224 to Bono, Jr.
U.S. Reissue Pat. No. 9,687 to Cox
French Pat. No. 524,805 to Laugier
French Pat. No. 1,453,665 to Auffret Of the above listed documents, only a few of them are even of general interest to the teachings of the present invention. In this regard, design U.S. Pat. No. D27,820 to Birtcherd teaches a fork having two elongated tines 4 two shortened tines 7 and a cutting edge, but lacks the tab structure and indicator structure of the present invention. Design U.S. Pat. No. D63,047 to Adler discloses a fork having two shortened tines similar to the teachings of Birtcherd but without teaching or suggestion of a cutting edge, tab structure or indicator structure. U.S. Pat. No. 1,294,031 to Bigelow discloses a fork-knife combination wherein the cutting edge extends along the major portion of the side of one of the tines C, however, no tab structure or indicator structure is taught or suggested by Bigelow, and, furthermore, all of the tines thereof are of equal length. While U.S. Pat. No. 2,685,734 to Klein teaches a stop device 15*b*, this device only delineates the dividing point between cutting edges of different types and as such could not be inferred as analogous to the indicator structure of the present invention. Finally, while French patent 1,453,665 to Auffret teaches the concept of a fork-knife combination wherein the cutting edge b does not extend the entire length of the tine c, again, Auffret lacks the tab structure, the indicator structure and the asymmetrical nature of the tines of the present invention.

Accordingly, a need has developed for an improved combination fork and knife including a cutting edge incorporated into a fork structure with the further provision of a tab structure to assist in controlling and applying pressure on the cutting edge during cutting operations and with the further provision of indicator structure which will protect the user against cutting of the user's mouth.

SUMMARY OF THE INVENTION

Incorporated by reference herein is Disclosure Document No 167763 filed Apr. 7, 1987.

The present invention overcomes the deficiencies found in prior art constructions by providing an improved combination fork and knife device including the following interrelated aspects and features:

(a) In a first aspect, the inventive device includes the structure of a fork including, in the preferred embodiment thereof, four tines defined by three spaces with two of the spaces being of equal depth and with the third space being shallower.

(b) Due to the shallow nature of the third space described above, the tine adjacent thereto to one side of the device does not have the elongated extent of the other three tines This structure provides a region at the base of the implement end which has increased structural strength due to the fact that it is a solid piece.

(c) Adjacent that solid piece portion of the implement end of the invention, a cutting edge is formed which is elongated approximately half the distance from the proximal end of the implement end toward the distal end thereof. The cutting edge terminates proximally of the beginning point of the third space described hereinabove so that the entire length of the cutting edge is adjacent a thick portion of the base region of the implement end for added strength.

(d) Distal of the cutting edge, the fourth and shortest tine is formed and between the termination of the cutting edge and the beginning of the fourth tine, an indicator structure is formed. In a first embodiment of this indicator structure, it is formed by a lateral spacing of the cutting edge from the side edge of the fourth tine. In a second embodiment, the cutting edge and side face of the fourth tine are co-linear, but are separated by a short raised portion which may be detected by the tongue or other mouth structure of the user.

(e) On the lateral side of the implement end opposite the lateral side having the cutting edge, and at the immediate proximal end of the implement end thereof, a tab structure is provided which includes a dished concave configuration. The tab structure is designed to be engaged by the end of the index finger of the user with the rest of the hand gripping the handle portion of the implement so that additional pressure and control may be applied on the cutting edge when the cutting edge is being used.

Accordingly, it is a first object of the present invention to provide an improved combination fork and knife utensil.

It is a further object of the present invention to provide such an improved combination fork and knife utensil having an indicator structure to indicate the termination point of the cutting edge thereof.

It is a further object of the present invention to provide such a utensil having a tab structure designed to be engaged by the index finger of the user so that additional pressure on the cutting edge may be applied.

It is a yet further object of the present invention to provide such a utensil with a shortened tine thereby providing increased structural rigidity in the region of the cutting edge.

It is a yet further object of the present invention to provide an asymmetrical implement end which provides a lengthier portion from the proximal end of the implement end to the distal end, offering a substantial safety margin (lateral edge 31) between the termination of the cutting edge (indicator) and the end of the fourth tine. The lateral edge 31 plus the cutting edge 41 are clearly greater in combined length than opposed side 13 to offer adequate cutting edge while maintaining an adequate safety margin (lateral edge 31).

These and other aspects, features and advantages of the present invention will be better understood from the following detailed description of the preferred embodiments thereof, when read in conjunction with the appended drawing figures.

SPECIFIC DESCRIPTION OF THE PREFERRED EMBODIMENTS

Figure 1:
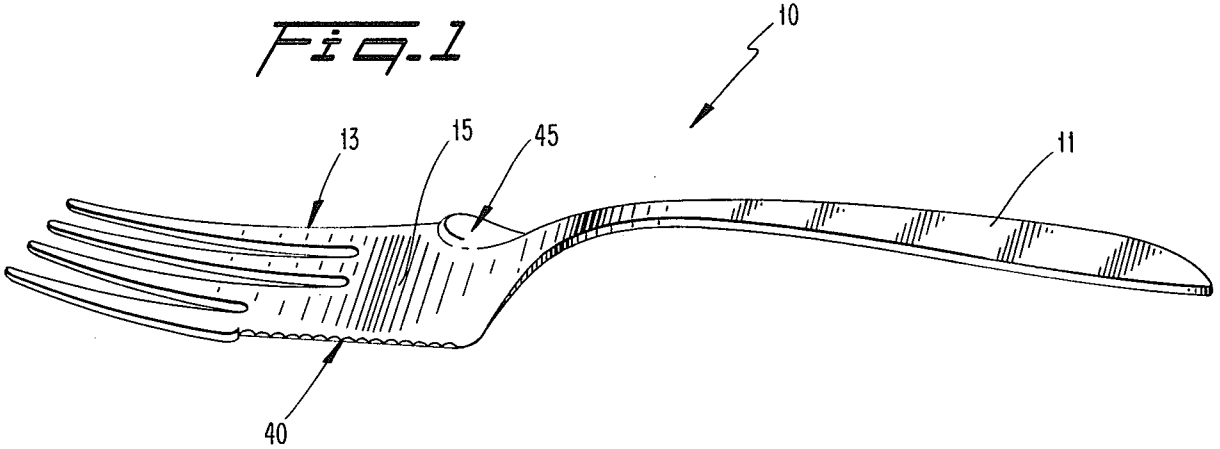
FIG. 1 shows a perspective view of a first embodiment of the present invention.
Figure 2:
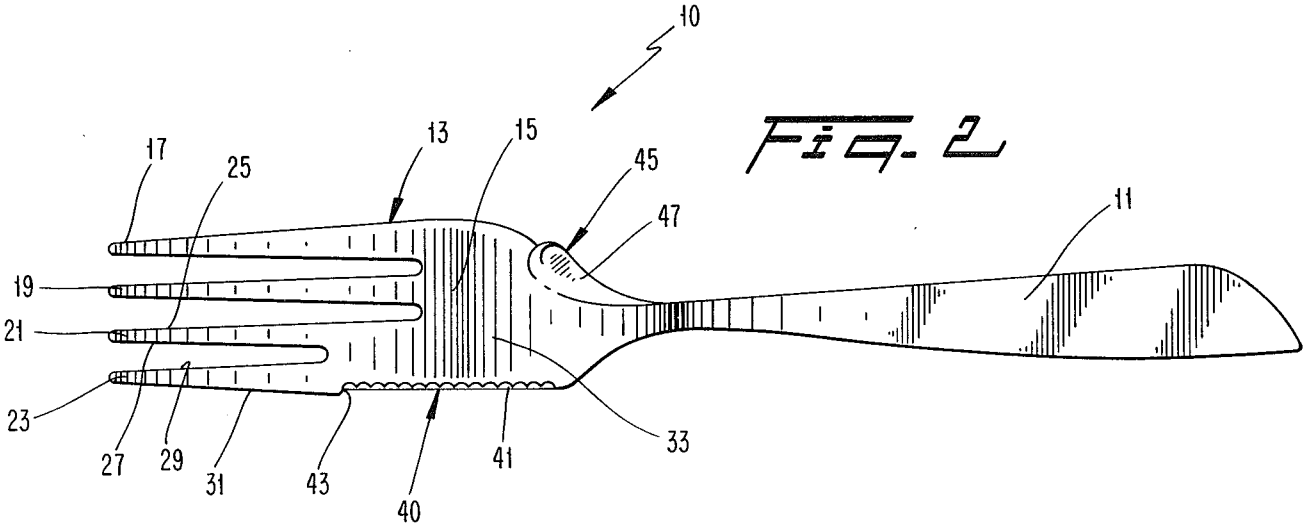
FIG. 2 shows side view of the embodiment of FIG. 1

With reference first to FIGS. 1 and 2, it is seen that the utensil 10 includes a handle 11 and an implement end 13 having a base portion 15 at its proximal end and a distal end including a plurality of tines designated by the reference numerals 17, 19, 21 and 23.

As should be understood from FIGS. 1 and 2, the tines 17 and 19 are of equal length and have side faces each of which extend all the way to adjacency with the base portion 15 of the implement end 13. The tine 21 has a side face 25 equal in length to the side faces of the tines 17 and 19 but has an opposed side face 27 which is much shorter than the side face 25. The tine 23 includes side faces 29 and 31 which are of substantially equal length to the side face 27 of the tine 21 for a purpose to be described in greater detail hereinafter.

As should be understood from FIGS. 1 and 2, due to the shortness of the faces 27 29 and 31, a region 33 is thereby created in the base portion 15 of the implement end 13 which is much stronger than it would be were the faces 27, 29 and 31 to extend the length of the side faces corresponding to that which is designated by the reference numeral 25.

On the lateral side of the implement end 13 of the utensil 10 adjacent the side face 31 of the tine 23, a knife 40 is formed by a cutting edge 41 which extends from the proximal end of the implement end 13 of the utensil 10 distally until terminating immediately adjacent the proximal end of the side face 31 of the tine 23.

As best seen in FIG. 2, the distal termination of the cutting edge 41 is defined by a shoulder 43 extending laterally with respect to the longitudinal extent of the utensil so that the side face 31 of the tine 23 extends substantially parallel to the longitudinal extent of the cutting edge 41 but laterally spaced therefrom. The shoulder 43 defines an indicator structure which is quite helpful to the user of the utensil in defining for the user where the tine 23 terminates and the cutting edge 41 begins. Due to the inclusion of the indicator structure defined by the shoulder 43, the user will be less likely to cut their mouth and associated tissues due to the inclusion of the cutting edge 41.

With further reference to FIGS. 1 and 2, it is seen that on the side of the base 15 of the implement end 13 of the inventive utensil 10, a tab structure 45 is formed and includes a concave surface 47 formed at an angle oblique to the longitudinal extent of the utensil 10, and also oblique to the longitudinal direction of elongation of the cutting edge 41. As clearly seen in FIG. 2 the cutting edge 41 and tab structure 45 are on opposed lateral faces of the base portion 15 of the implement end 13. As should be understood, the concave surface 47 is designed to be engaged by the index finger of the user of the utensil 10 with the rest of the hand gripping the handle portion 11 thereof so that during cutting operations using the blade 41, the index finger may be utilized via the tab structure 45 to exert additional pressure on the cutting blade 41 to better facilitate cutting operations. During such cutting operations where the index finger is utilized to exert pressure on the cutting blade 41 via the base portion 15 of the implement end 13 of the utensil 10, the structural integrity of the utensil 10 is extremely important. For this reason, it is highly advantageous to provide the shortened structure of the sides 27, 29 and 31 of the tines 21 and 23 to thereby provide the strengthened region 33 which in effect transfers forces exerted on the tab structure 45 to the cutting edge 41.

Figure 3:
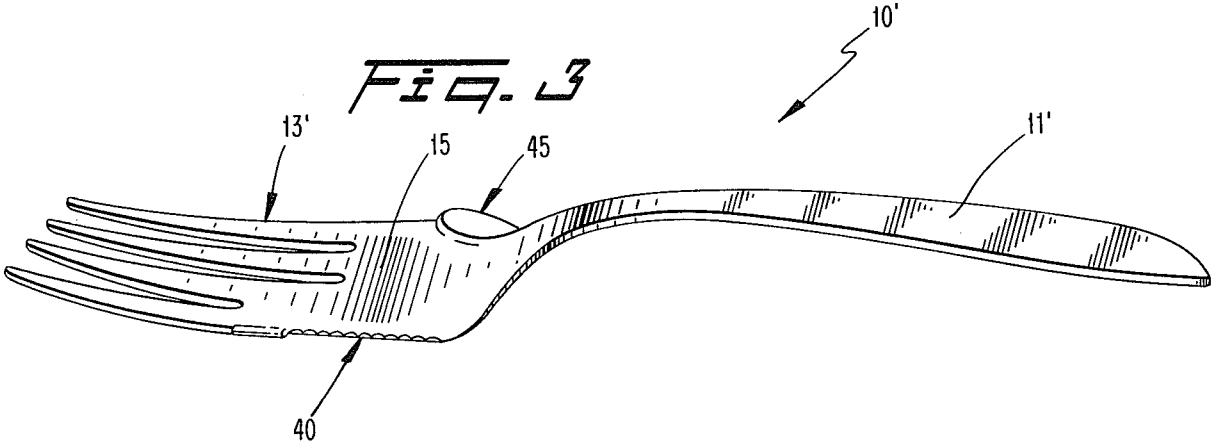
FIG. 3 shows a perspective view of a second embodiment of the present invention.
Figure 4:
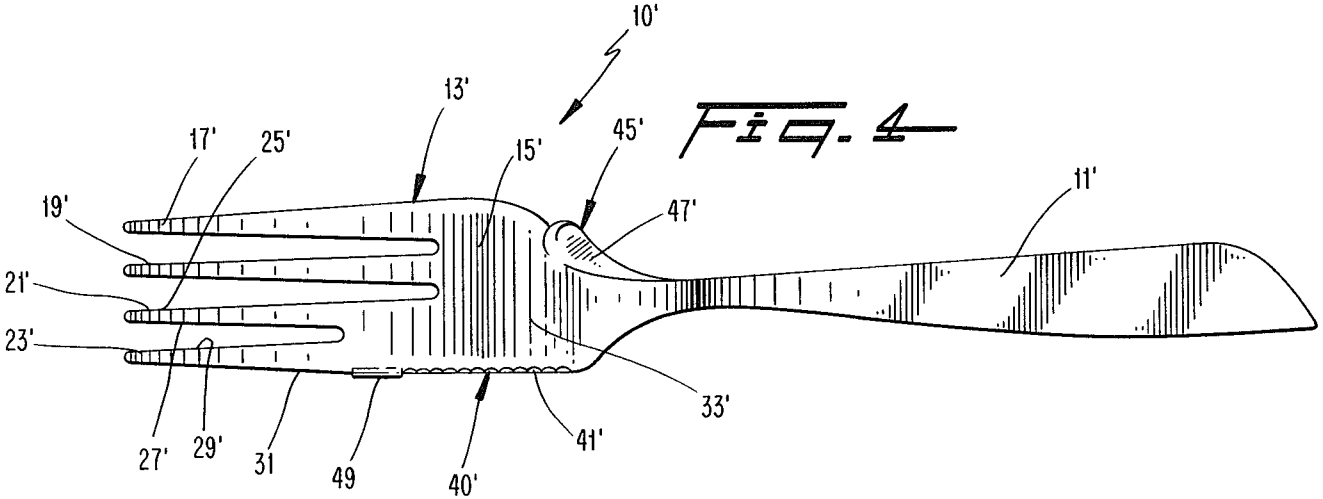
FIG. 4 shows a side view of the embodiment of FIG. 3.

With reference to FIGS. 3 and 4, a second embodiment of the present invention will be described in detail, with features in common with the embodiment illustrated in figures 1 and 2 being designated by like primed reference numerals.

With reference to FIGS. 3 and 4, it is seen that the inventive utensil 10' includes a handle portion 11', an implement end 13' having a base portion 15', a strengthened region 33', tines 17', 19', 21' and 23', a knife portion 40' including a cutting edge 41' with the tine 23' being shortened and defining a shortened lateral edge 31'. Furthermore, the inventive utensil 10' includes the tab structure 45' including the concave surface 47'.

What is different about the embodiment of figures 3 and 4 as compared to the embodiment of FIGS. 1 and 2 is found in the indicator structure thereof. Referring bakk to FIGS. 1 and 2, it is seen that the indicator structure thereof is defined by a shoulder 43 defining a lateral spacing between the cutting edge 41 and the lateral edge 31 of the shortened tine 23. As opposed to this structure, in the embodiment illustrated in FIGS. 3 and 4, the cutting edge 41' and the lateral edge 31' of the shortened tine 23' are substantially co-linear. However, separating the edge 31' from the cutting edge 41' is a raised bump 49 defining the indicator structure of the utensil 10'. The raised bump 49 defines the transition from the lateral edge 31' of the tine 23' and the cutting edge 41'. Through the inclusion of the bump 49, the user of the utensil 10' may easily discern when the edge 31' ends and the cutting edge 41' comences to thereby avoid cutting of the user's mouth and associated tissues.

Of course, the present invention may be made of any desired materials including stainless steel, silverplate, sterling silver as well as plastic, wood and other known materials. One example of a process which may be utilized to make the inventive utensil in either of its embodiments out of a metallic material is the technique of "drop-forging". Of course, any known or desired technique of manufacturing the inventive utensil 10 or 10' may be utilized.

Accordingly, an invention has been disclosed in terms of two preferred embodiments thereof which overcome each and every one of the deficiencies as found in prior art designs and provide an integrated combination utensil which may be utilized to replace a fork and knife with a single utensil. Of course, various changes, modifications and alterations in the teachings of the present invertion may be contemplated by those skilled in the art without departing from the intended spirit and scope thereof. Accordingly, it is intended that the present invention only be limited by the terms of the appended claims.

I claim:

1. An improved combination utensil comprising:

(a) a handle portion;

(b) an asymmetrical implement end having a longitudinal extent and connected to said handle portion and including:

(i) a base portion having a proximal end connected to said handle portion, two opposed lateral sides and a distal end;

(ii) a fork portion including a plurality of tines attached to said distal end;

(iii) a knife portion including a longitudinal cutting edge on one of said lateral sides of said base portion comprising the sole cutting edge on said utensil and extending toward but not to said distal end;

(iv) one of said tines proximally commencing adjacent a distal termination of said cutting edge;

(v) an indicator comprising a lateral protrusion extending laterally outward relative to said cutting edge and defining said distal termination and;

(vi) a tab structure protruding from the other of said lateral sides and designed to bearingly receive an index finger of a user of said utensil, said tab structure providing a surface for to apply pressure and have control on said cutting edge.

2. The invention of claim 1, wherein said one of said tines is shorter than another of said tines, thereby defining a reinforced region of said base portion adjacent said cutting edge.

3. The invention of claim 1, wherein said tab structure includes a concave surface formed at an angle oblique to the longitudinal extent of said implement end.

4. The invention of claim 1, made of plastic.

5. The invention of claim 1, made of material.

6. The invention of claim 1, wherein said tab structure and knife portion are oriented for use with a right hand.

* * * * *